US010144625B2

(12) United States Patent
Giattina

(10) Patent No.: US 10,144,625 B2
(45) Date of Patent: Dec. 4, 2018

(54) MODULE MOVING SYSTEMS

(71) Applicant: Chris Giattina, Birmingham, AL (US)

(72) Inventor: Chris Giattina, Birmingham, AL (US)

(73) Assignee: BLOX, LLC, Bessemer, AL (US)

( * ) Notice: Subject to any disclaimer, the term of this patent is extended or adjusted under 35 U.S.C. 154(b) by 527 days.

(21) Appl. No.: 14/681,633

(22) Filed: Apr. 8, 2015

(65) Prior Publication Data

US 2016/0297652 A1 Oct. 13, 2016

(51) Int. Cl.

*B66F 3/24* (2006.01)
*B66F 3/46* (2006.01)
*B66C 1/12* (2006.01)

(52) U.S. Cl.

CPC ..... *B66F 3/46* (2013.01); *B66C 1/12* (2013.01); *B66F 3/24* (2013.01)

(58) Field of Classification Search

CPC ..... B66F 3/00; B66F 3/02; B66F 3/08; B66F 3/10; B66F 3/14–3/20; B66F 5/00; B66F 5/025; B66F 7/10–7/14

See application file for complete search history.

(56) References Cited

U.S. PATENT DOCUMENTS 530,437 A * 12/1894 Mason ..... B62B 5/0083 269/17
1,067,625 A * 7/1913 Smith ..... B66F 3/08 254/7 R
2,785,814 A * 3/1957 Corley ..... B62B 3/04 269/17
3,195,859 A * 7/1965 Jackson ..... B60B 33/06 254/2 R
3,327,996 A * 6/1967 Morse ..... B66F 3/24 254/2 R
3,768,676 A * 10/1973 Spitzer ..... B66F 19/00 254/2 C
4,491,452 A * 1/1985 Matovich ..... B60B 29/002 254/4 R
4,611,816 A * 9/1986 Traister ..... B65D 90/143 280/43.2
4,623,125 A * 11/1986 Ebey ..... B60D 1/66 254/418
4,913,614 A * 4/1990 O'Rarden ..... B62B 3/10 187/244
4,934,893 A * 6/1990 Johnson ..... B62B 3/06 254/2 R
5,009,406 A * 4/1991 McDermott ..... B25H 1/0007 269/17

(Continued)

*Primary Examiner* — Tyrone V Hall, Jr.

(74) *Attorney, Agent, or Firm* — C. Brandon Browning; Maynard, Cooper & Gale, PC

(57) ABSTRACT

The present disclosure generally pertains to a system for lifting and moving pre-fabricated building modules. In certain embodiments, a lifting apparatus is provided, wherein a frame is configured to attach to the exterior surface of a pre-fabricated module and wherein the lifting apparatus, along with an attached pre-fabricated module, may be lifted and moved either by rolling the lifting apparatuses or by hoisting the pre-fabricated module using a crane attached to brackets on the lifting apparatuses. The height of the lifting apparatus may be adjusted using a source of force, such as a crank-operated or hydraulic jack, to attach the lifting apparatus to a pre-fabricated module.

15 Claims, 7 Drawing Sheets

(56) References Cited

U.S. PATENT DOCUMENTS

| | | | | | |
|---|---|---|---|---|---|
| 5,044,864 | A * | 9/1991 | Stefan | B60B 33/06 | 254/45 |
| 5,660,518 | A * | 8/1997 | Meier | B62B 5/0083 | 180/41 |
| 5,716,186 | A * | 2/1998 | Jensen | A47F 5/108 | 187/244 |
| 5,800,114 | A * | 9/1998 | Secondi | B65D 90/143 | 280/43.23 |
| 5,924,168 | A * | 7/1999 | Webb | A47B 47/021 | 16/30 |
| 6,213,491 | B1 * | 4/2001 | Southard, Jr. | B60D 1/66 | 254/420 |
| 6,302,381 | B1 * | 10/2001 | Roll | B60D 1/66 | 254/418 |
| 2001/0008344 | A1 * | 7/2001 | Lanciaux, Jr. | B65D 90/146 | 294/67.33 |
| 2001/0048055 | A1 * | 12/2001 | Baril | A47F 10/00 | 248/188.1 |
| 2003/0091417 | A1 * | 5/2003 | Swann | B62B 5/0083 | 414/458 |
| 2005/0225047 | A1 * | 10/2005 | Schilling | A47F 5/108 | 280/79.7 |
| 2013/0181176 | A1 * | 7/2013 | Paulk | B66F 5/00 | 254/2 R |
| 2016/0244204 | A1 * | 8/2016 | DeBattiste | B66F 3/46 | |

* cited by examiner

MODULE MOVING SYSTEMS

RELATED ART

The prefabrication of building components reduces construction costs and waste while also increasing efficiency. Large, pre-fabricated building modules, for example, are commonly used in the construction of buildings and dramatically reduce total construction time. Such modules, however, are typically heavy and cumbersome. Despite their prevalent use, the current means of lifting and moving these modules, such as with large, specialized cranes, remains inefficient, expensive, and risks damage to the modules and surrounding structure. Further, space and budget constraints at construction locations often preclude the use of such large, specialized equipment. Therefore, a system capable of lifting and moving wall panels efficiently, inexpensively, and without a high risk of damage to the wall panels or other structures is generally desirable.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to a system for lifting and moving pre-fabricated building modules. In certain embodiments, a lifting apparatus is provided, wherein a frame is configured to attach to the exterior surface of a pre-fabricated module and wherein the lifting apparatus, along with an attached pre-fabricated module, may be lifted and moved either by rolling the lifting apparatuses or by hoisting the pre-fabricated module using a crane attached to brackets on the lifting apparatuses. The height of the lifting apparatus may be adjusted using a source of force, such as a crank-operated or hydraulic jack, to attach the lifting apparatus to a pre-fabricated module.

The use of any and all examples, or exemplary language ("e.g.," "such as," or the like) provided herein, is intended merely to better illuminate the embodiments and does not pose a limitation on the scope of the embodiments.

As used herein, "alloy" means pure metals and metals including incidental impurities and/or purposeful additions of metals and/or non-metals. For example, alloy may mean aluminum. Other examples of alloys include brass, bronze, copper, duralumin, Inconel, nickel, steel, titanium, other alloys known to those skilled in the art, and combinations of the same.

As used herein, "bracket" means an anchored fixture capable of supporting a load.

As used herein, "composite" means engineered materials made from two more constituent materials. Examples of composites include, but are not limited to, carbon composites, in which carbon fiber is embedded in a matrix or resin, including epoxy matrices, thermosetting or thermoplastic resins, as well as composites containing fiberglass, ceramics, and other elements.

As used herein, "hoist" means a device configured to support and/or lift a load. Examples of hoists include, but are not limited to, cranes, pulleys, and like devices known in the art.

As used herein, "jack" means a device configured to support or lift a load through the application of force, including, but not limited to, mechanical jacks, such as screw jacks and scissor jacks, which may be crank-operated, hydraulic jacks, such as floor jacks, bottle jacks, and barrel jacks, pneumatic jacks, strand jacks, and farm jacks.

As used herein, "pre-fabricated module" means a pre-fabricated room or wall panel for use in construction. Examples of pre-fabricated modules include, but are not limited to, pre-fabricated medical examination rooms, bathrooms, wall panels and the like.

As used herein, "rope" means any rope, chain, wire, or cable capable of supporting a load. Examples of rope include, but are not limited to, rope composed of natural and/or synthetic fibers, metal chain, metal wire, metal cable and the like known in the art.

Figure 1:
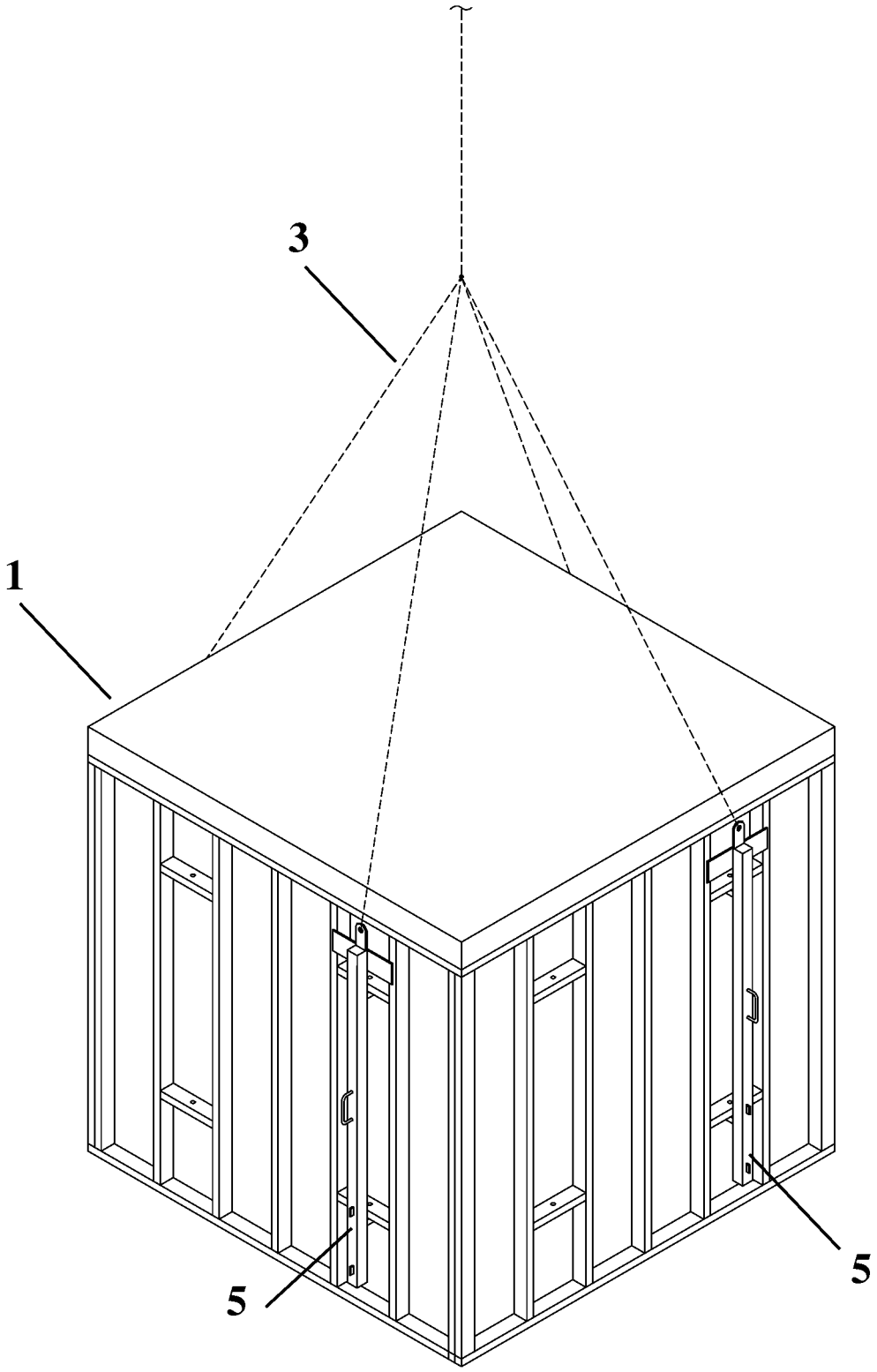
FIG. 1 depicts an exemplary embodiment of a pre-fabricated module suspended by a hoist attached to multiple lifting apparatuses, each without a jack, each engaged with the pre-fabricated module.
Figure 4:
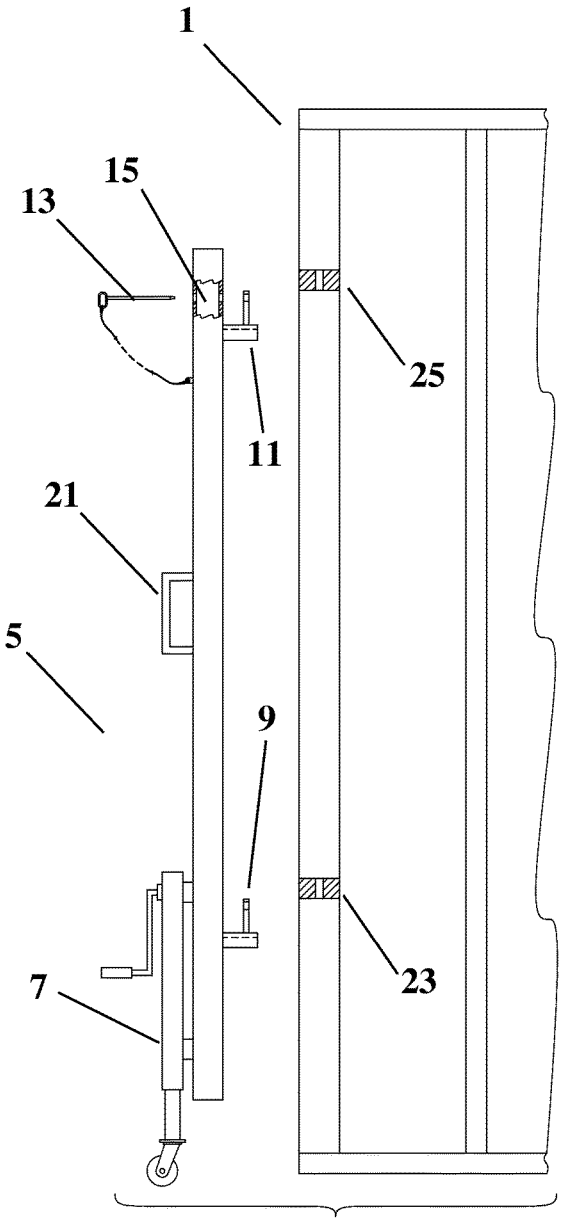
FIG. 4 depicts an exemplary embodiment of a lifting apparatus, equipped with a crank-operated jack, positioned adjacent to a pre-fabricated module.
Figure 7:
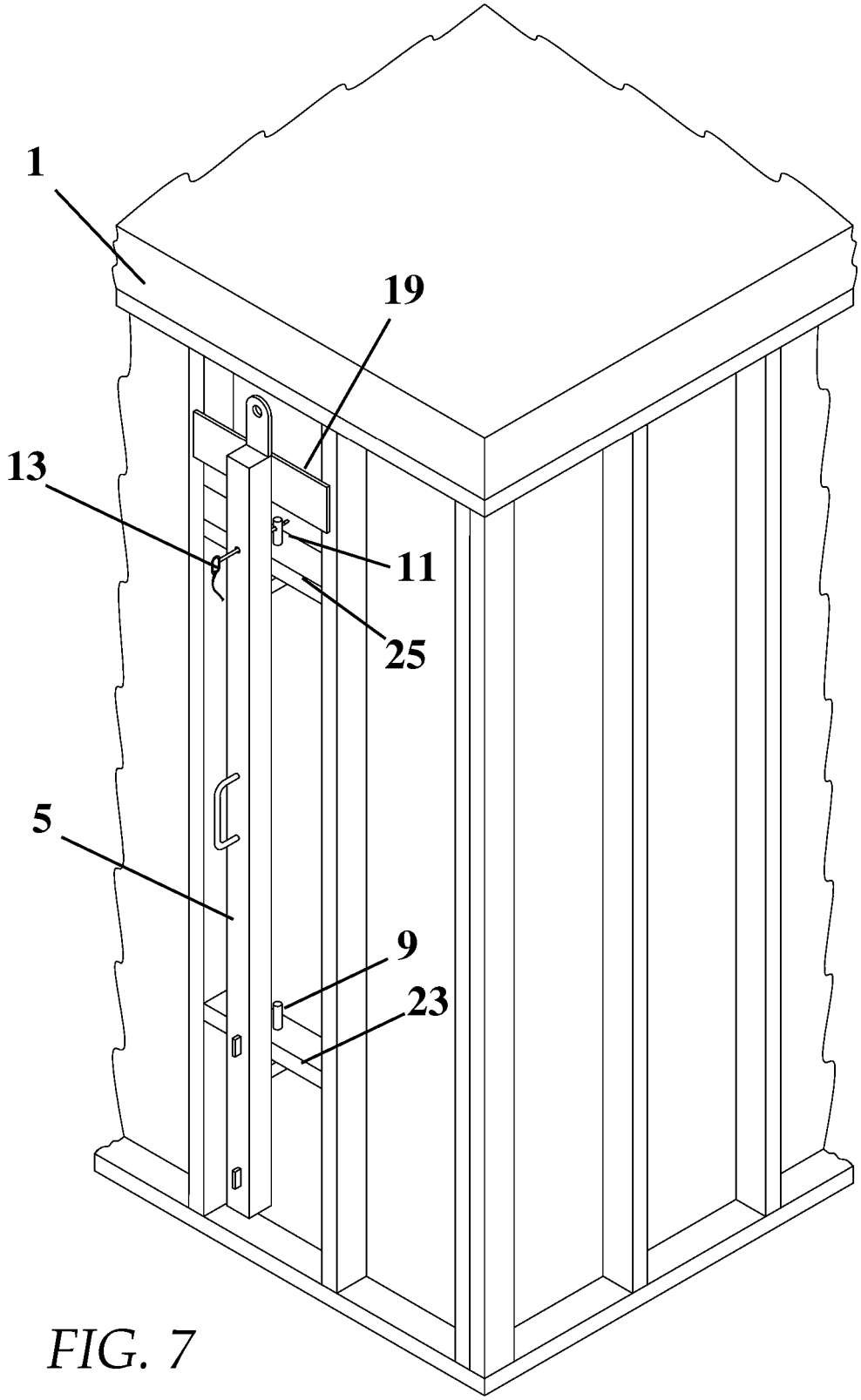
FIG. 7 depicts an exemplary embodiment of a lifting apparatus, without a jack, engaged with a pre-fabricated module.

FIG. 1 depicts an exemplary embodiment of a pre-fabricated module 1. The pre-fabricated module 1 contains at least one wall. In certain embodiments, the pre-fabricated module 1 includes a floor. In certain embodiments, the pre-fabricated module 1 includes a ceiling. The exterior face of each wall of the pre-fabricated module 1 contains at least one lower aperture 23 and at least one upper aperture 25, each located within horizontal crossmembers flanked by vertical beams of the frame, such as depicted in FIGS. 4 and 7. In certain embodiments, the lower aperture 23 and upper aperture 25 are configured to accept the inserting of pins, bolts, clamps, and the like. In certain embodiments, the lower aperture 23 and upper aperture 25 are incrementally spaced at uniform distances. For example, the upper apertures 25 may be incrementally spaced 10 cm apart. In certain embodiments, the lower aperture 23 and upper aperture 25 are aligned vertically.

Figure 2:
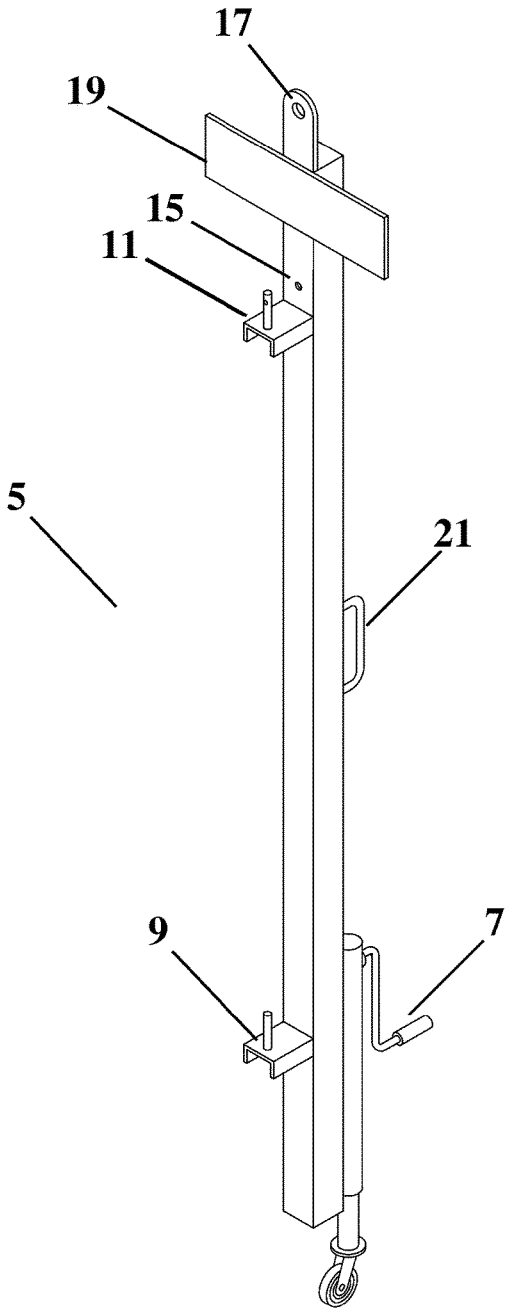
FIG. 2 depicts one perspective of an exemplary embodiment of a lifting apparatus, equipped with a crank-operated jack.
Figure 3:
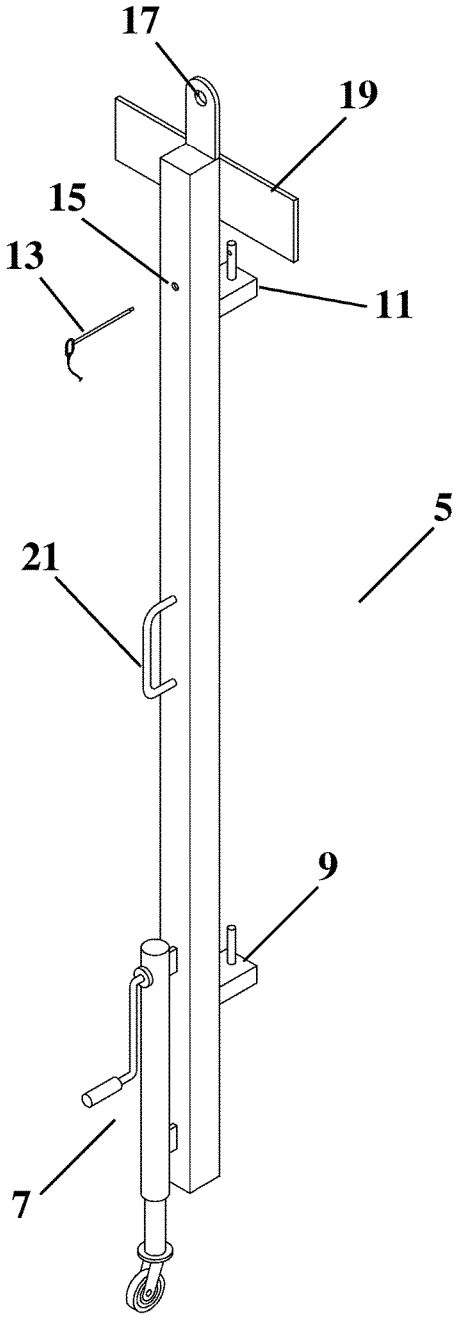
FIG. 3 depicts an alternative perspective of an exemplary embodiment of a lifting apparatus, equipped with a crank-operated jack.
Figure 5:
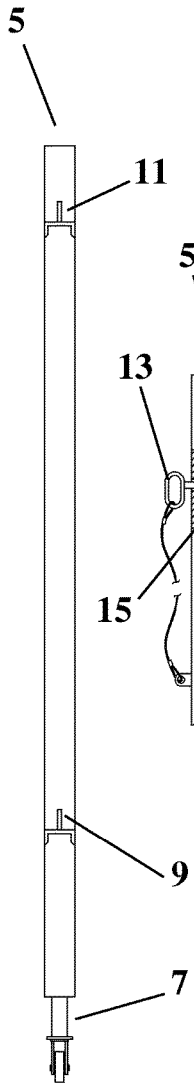
FIG. 5 depicts an alternative perspective of an exemplary embodiment of a lifting apparatus, equipped with a crank-operated jack.

An exemplary embodiment of a lifting apparatus 5 is depicted in FIGS. 2, 3 and 5. The lifting apparatus 5 is composed of an elongated member having a lower bracket 9 and upper bracket 11 on one face. In certain embodiments, the elongated member is hollow. In certain embodiments, the lifting apparatus 5 includes a crank-operated jack 7. In certain embodiments, the crank-operated jack 7 is attached proximal to the base of the lifting apparatus 5. In certain embodiments, the crank-operated jack 7 is detachable from the lifting apparatus 5. In certain embodiments, the crank-operated jack 7 includes an outer sleeve and an inner sleeve, configured such that turning the crank raises or lowers the height of the outer sleeve relative to the inner sleeve, depending on the direction the crank is turned. For example, the crank-operated jack 7 may include a gearbox which includes an external adjustment handle connected to a vertical spider gear and horizontal spider within the gearbox. The horizontal spider gear may be attached to an elongated threaded bolt which is engaged by a nut attached to the support post. The gearbox may be configured such that turning the adjustment handle will cause the threaded bolt to thread into or out of the nut, depending on the direction the handle is turned, thereby raising or lowering the positioning post.

In certain embodiments, the lifting apparatus 5 includes at least one wheel attached to the base of the apparatus 5, configured to allow the apparatus 5 to be pivoted and rolled in any direction across a surface. For example, the wheel may be a caster, configured to allow the wheel to swivel in any direction, or other wheel known in the art. In certain embodiments, the lifting apparatus 5 is configured to allow the apparatus 5 to be wheeled from one location to another while engaged with a pre-fabricated module 1. In certain embodiments, a handle 21 is attached on the face of the lifting apparatus 5 opposing the face to which the lower bracket 9 and upper bracket 11 are attached. In certain embodiments, the handle 21 is positioned approximately in the middle of the vertical length of the lifting apparatus 5.

The lower bracket 9 and upper bracket 11 of the lifting apparatus 5 each include a vertical support pin configured to fit through a lower aperture 23 and upper aperture 25, respectively, on a pre-fabricated module 1. The lower aperture 23 and upper aperture 25 are contained within horizontal crossmembers on the exterior surface of the pre-fabricated module 1 and are configured such that the base of the lower bracket 9 and upper bracket 11 are in contact with the bottom surface of the crossmembers when the lifting apparatus 5 engages the pre-fabricated module 1. This configuration enhances the ability of the lifting apparatus 5 to support the weight of the pre-fabricated module 1.

In certain embodiments, the vertical support pin of at least one of the lower bracket 9 and upper bracket 11 includes an aperture aligned with an aperture 15 on the elongated member of the lifting apparatus 5 which extends through the lifting apparatus 5, configured to allow a locking pin 13 to pass through both apertures. In certain embodiments, the locking pin 13 may include pins, bolts, clamps, and the like. In certain embodiments, one end of the locking pin 13 is secured to an outer face of the lifting apparatus 5 with a cable. In certain embodiments, the lifting apparatus 5 further includes at least one brace 19 perpendicular to and attached to the same face of the lifting apparatus 5 as the lower bracket 9 and upper bracket 11, such as depicted in FIGS. 2 and 3. The brace 19 is designed to contact at least two vertical beams on the exterior of a pre-fabricated module 1 when the lower bracket 9 and upper bracket 11 of the lifting apparatus 5 are engaged with the lower aperture 23 and upper aperture 25, respectively. In certain embodiments, the surface of the brace 19 is coated with a protective material, such as rubber or other padding material known in the art, to reduce damage to the pre-fabricated module 1.

In certain embodiments, the lifting apparatus 5 further includes a lifting aperture 17. The lifting aperture 17 is an aperture configured to allow the threading of rope 3. In certain embodiments, the lifting aperture 17 is located at the top of the lifting apparatus 5 and integrated into the frame of the lifting apparatus 5 to increase structural integrity. For example, one face of the lifting apparatus 5 may extend above the remaining faces, such as is depicted in FIGS. 2 and 3.

In certain embodiments, the lifting apparatus 5 is composed of an alloy. In other embodiments, the lifting apparatus 5 is composed of a composite.

Figure 6:
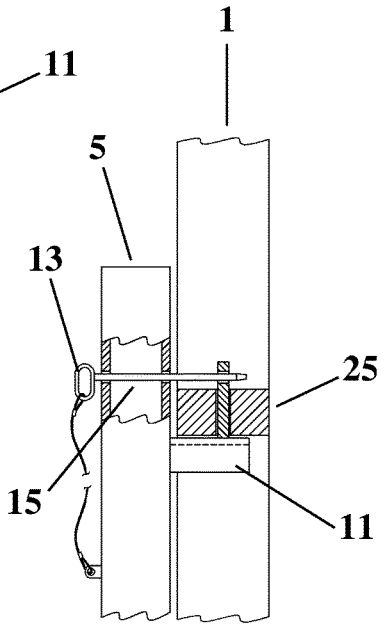
FIG. 6 depicts a partial perspective of an exemplary embodiment of a lifting apparatus engaged with a portion of a pre-fabricated module.

The lifting apparatus 5 is configured to engage a pre-fabricated module 1. FIG. 4 depicts an exemplary embodiment of a lifting apparatus 5, equipped with a crank-operated jack 7, positioned adjacent to a pre-fabricated module 1. FIG. 6 depicts a partial perspective of an exemplary embodiment of a lifting apparatus 5 engaged with a portion of a pre-fabricated module 1 such that the vertical support pin of the upper bracket 11 of the lifting apparatus 5 is fitted through an upper aperture 25 of the pre-fabricated module 1 with a locking pin 13 inserted through the upper bracket 11 and the aperture 15.

FIG. 1 depicts an exemplary embodiment of a pre-fabricated module 1 suspended by rope 3 attached to both a hoist (not shown) and to multiple lifting apparatuses 5, each without a jack and each engaged with the pre-fabricated module 1. Similarly, FIG. 7 depicts an exemplary embodiment of a lifting apparatus 5, without a jack, engaged with a pre-fabricated module 1. As shown in FIG. 7, the lifting apparatus 5 includes a brace 19 in contact with the outer surface of the pre-fabricated module 1 to reduce movement of the lifting apparatus 5 when attached to the pre-fabricated module 1. FIG. 7 further depicts a locking pin 13 inserted through both the upper bracket 11 and aperture 15 to further secure the lifting apparatus 5 to the pre-fabricated module 1.

Figure 8:
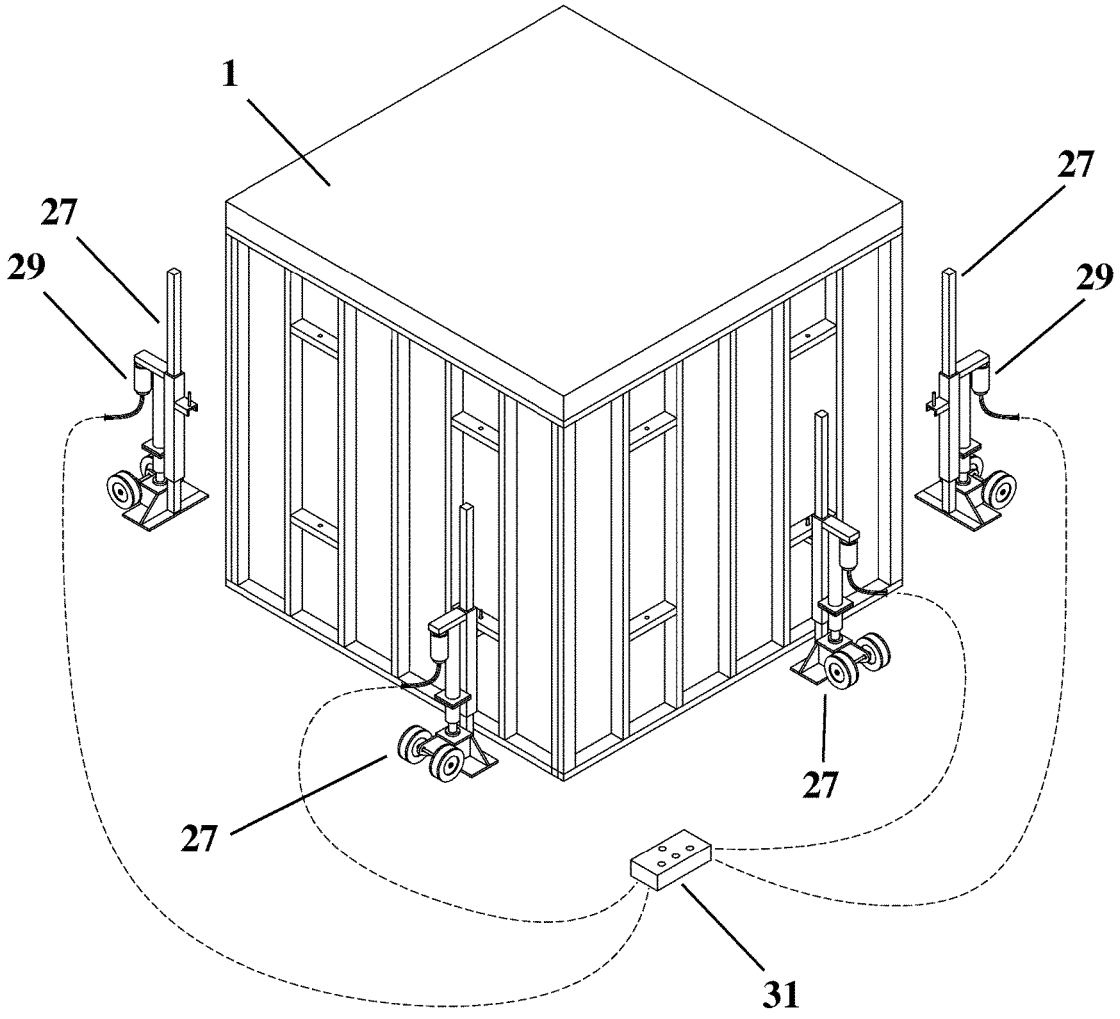
FIG. 8 depicts multiple lifting apparatuses, each equipped with a hydraulic jack, engaged with and positioned adjacent to a pre-fabricated module.
Figure 9:
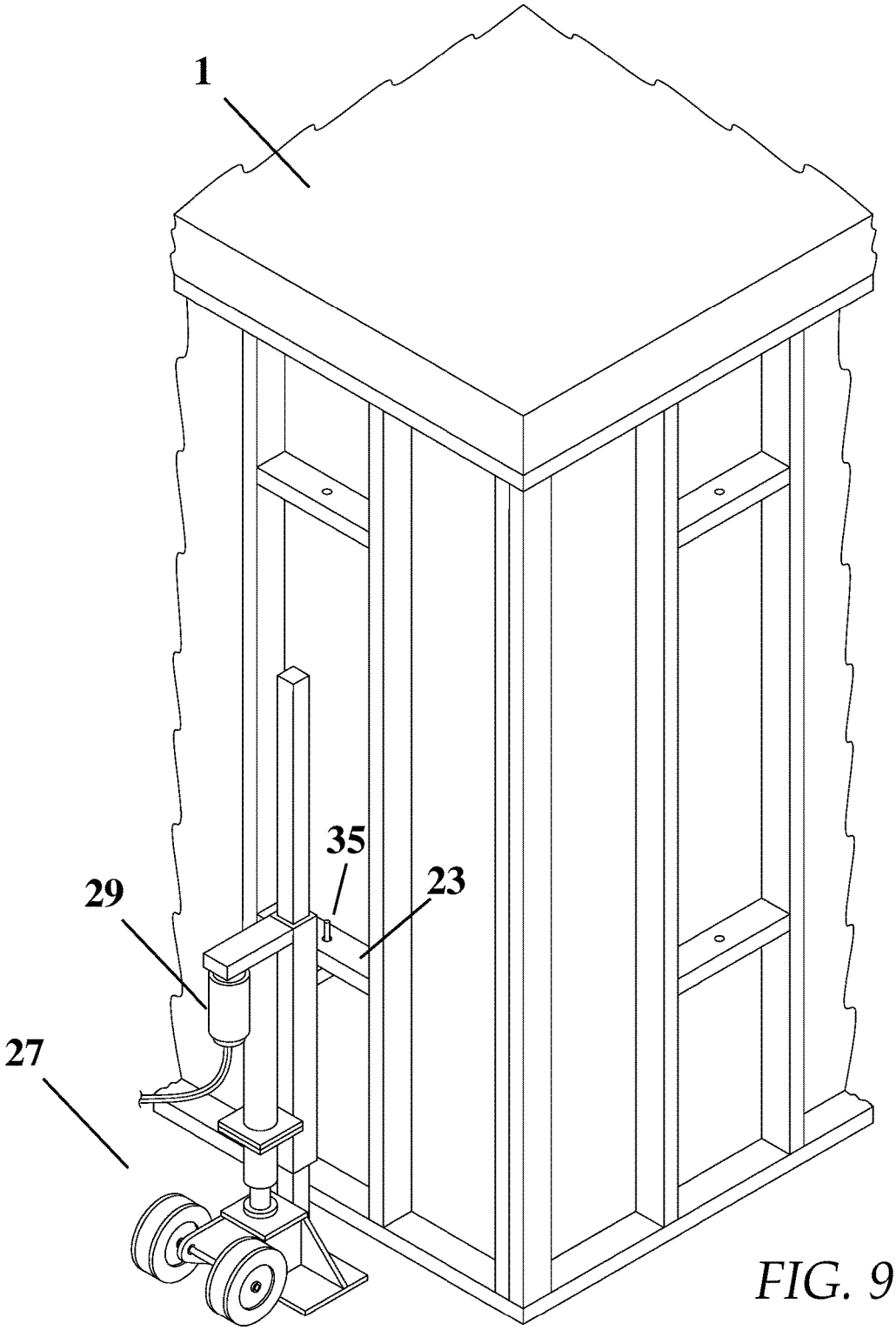
FIG. 9 depicts an exemplary embodiment of a lifting apparatus, equipped with a hydraulic jack, engaged with a pre-fabricated module.
Figure 10:
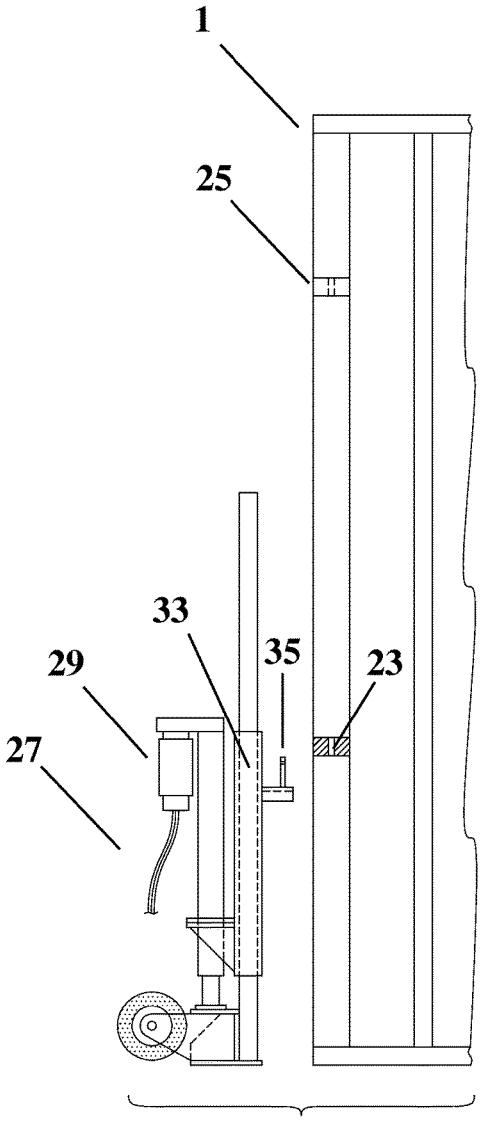
FIG. 10 depicts an exemplary embodiment of a lifting apparatus, equipped with a hydraulic jack, positioned adjacent to a pre-fabricated module.
Figure 11:
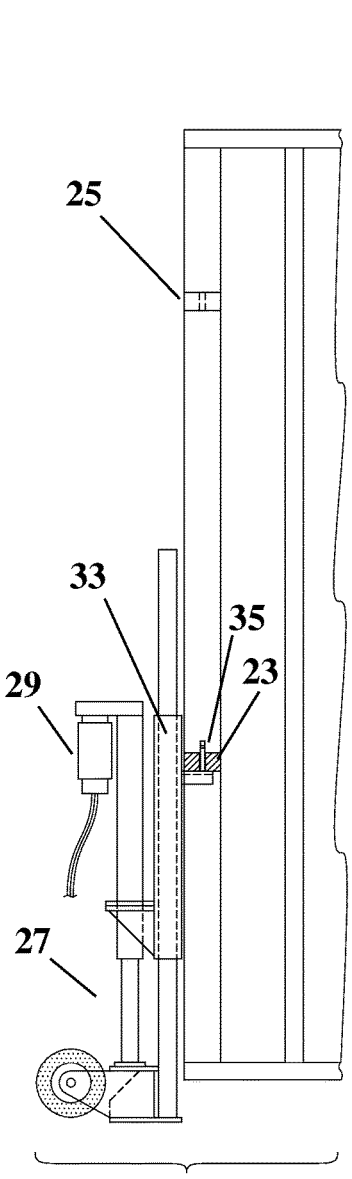
FIG. 11 depicts an exemplary embodiment of a lifting apparatus, equipped with a hydraulic jack, engaged with and lifting a pre-fabricated module.
Figure 12:
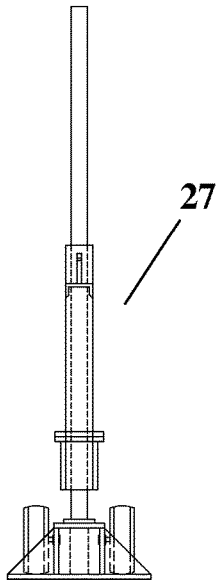
FIG. 12 depicts an alternative perspective of an exemplary embodiment of a lifting apparatus, equipped with a hydraulic jack.

The present disclosure further contemplates a lifting apparatus 27 equipped with a hydraulic jack 29, an exemplary embodiment of which is depicted in FIG. 12. FIG. 10 depicts an exemplary embodiment of a lifting apparatus 27, equipped with a hydraulic jack 29, positioned adjacent to a pre-fabricated module 1. The lifting apparatus 27 includes a support bracket 35 mounted on a sleeve 33, which is configured to raise and lower by operation of the hydraulic jack 29. FIGS. 9 and 11 depict an exemplary embodiment of a lifting apparatus 27, equipped with a hydraulic jack 29, engaged with a pre-fabricated module 1 such that the support bracket 35 is inserted through the lower aperture 23 of the pre-fabricated module 1. FIG. 8 depicts multiple lifting apparatuses 27, each equipped with a hydraulic jack 29, engaged with and positioned adjacent to a pre-fabricated module 1. In certain embodiments, the lifting apparatus 27 includes at least one wheel at its base, configured to allow the lifting apparatus 27 to be wheeled from one location to another. In certain embodiments, two or more lifting apparatuses 27 are connected to a control device 31, such as depicted in FIG. 8, wherein the control device 31 is configured to simultaneously and equally adjust the hydraulic jack 29 in all lifting apparatuses 27 to which it is connected. In certain embodiments, the lifting apparatus 27 is composed of an alloy. In other embodiments, the lifting apparatus 27 is composed of a composite.

In certain embodiments, the present disclosure contemplates a method of lifting a pre-fabricated module 1 using at least two lifting apparatuses 5 by: positioning each lifting apparatus 5 against the pre-fabricated module 1, inserting the lower bracket 9 and upper bracket 11 of each lifting apparatus 5 into a lower aperture 23 and upper aperture 25, respectively, of the pre-fabricated module 1 by raising each lifting apparatus 5 using a crank-operated jack 7; securing each lifting apparatus 5 to the pre-fabricated module 1 by inserting a locking pin 13 through the aperture 15 on each lifting apparatus 5 and through the upper bracket 11; connecting a rope 3 from a hoist to each lifting aperture 17 of the lifting apparatus 5, and lifting the pre-fabricated module 1 by operation of a hoist. In certain embodiments, the crank-operated jack 7 is removed from each lifting apparatus 5 once the pre-fabricated module 1 is supported by the hoist. FIG. 1, for example, depicts a pre-fabricated module 1 with a rope 3 secured to multiple lifting apertures 17 on multiple lifting apparatuses 5 (hoist not shown). By raising the hoist, the pre-fabricated module 1 will also raise. Similarly, the hoist may be turned to move the pre-fabricated module 1, attached to the hoist, to a desired location.

In certain embodiments, the present disclosure contemplates a method of lifting a pre-fabricated module 1 using at least two lifting apparatuses 27 by: positioning each lifting apparatus 27 against the pre-fabricated module 1 and inserting the support bracket 35 of each lifting apparatus 27 into a lower aperture 23 of the pre-fabricated module 1 by raising each lifting apparatus 27 using a hydraulic jack 29 using a control device 31 connected to each lifting apparatus 27 such that the control device 31 is configured to raise each lifting apparatus 27 equally and simultaneously. In certain embodiments, the method of lifting a pre-fabricated module 1 includes the use of at least one lifting apparatus 27 per side of the pre-fabricated module 1. In certain embodiments, the method of lifting the pre-fabricated module 1 further includes the steps of attaching at least two lifting apparatuses 5 to the pre-fabricated module 1 as described in the preceding paragraph.

In certain embodiments, the present disclosure contemplates a method of moving a pre-fabricated module 1 using at least two lifting apparatuses 5 by: positioning each lifting apparatus 5 against the pre-fabricated module 1, inserting the lower bracket 9 and upper bracket 11 of each lifting apparatus 5 into the lower aperture 23 and upper aperture 25, respectively, of the pre-fabricated module 1 by raising each lifting apparatus 5 using a crank-operated jack 7; securing each lifting apparatus 5 to the pre-fabricated module 1 by inserting a locking pin 13 through the aperture 15 on each lifting apparatus 5 and through the upper bracket 11; and moving the pre-fabricated module 1 by rolling the module 1 using the wheels at the base of each lifting apparatus 5. The handle 21 on each lifting apparatus 5 may be used to push or pull the pre-fabricated module 1 to a desired location. In certain embodiments, the method of moving a pre-fabricated module 1 includes the use of at least one lifting apparatus 5 per side of the pre-fabricated module 1.

A significant benefit of the lifting apparatuses 5 described herein is that such lifting apparatuses 5 may be used in conjunction with a hoist to permit the movement of pre-fabricated modules 1 using conventional cranes. In other words, the system disclosed herein not only allows the novel positioning of building pre-fabricated modules 1 by rolling such modules 1 on the lifting apparatuses 5, but it is also compatible with existing methods of hoisting pre-fabricated modules 1.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

The compositions, concentrations, and vehicles of the various embodiments described herein are exemplary. Various other compositions, concentrations, and vehicles for the formulations described herein are possible.

Now, therefore, the following is claimed:

1. A system for positioning a pre-fabricated module comprising:

at least one lifting member, each including a vertically-arranged elongated member;

at least one bracket attached to one face of the elongated member, wherein each bracket includes a vertically-aligned support pin;

at least one brace attached coplanar with, but perpendicular to, the face of the elongated member to which each bracket is attached, wherein a first side of the at least one brace is configured to contact the pre-fabricated module; and a lifting aperture attached to extend above the top of the elongated member, wherein the vertical support pin of an upper bracket of the lifting member includes an aperture therethrough, which is aligned with an aperture through the elongated member of the lifting member.

2. The system according to claim 1, wherein the lifting member includes a jack member operatively coupled to the vertically-arranged elongated member, the jack member being selected from the group consisting of a manually-powered crank-operated jack and a hydraulically-powered jack.

3. The system according to claim 2, wherein the lifting member includes a crank-operated jack with a wheeled member affixed to the base of the jack.

4. The system according to claim 3, wherein the wheeled member is a caster.

5. The system according to claim 2, wherein the jack member is selectively removable.

6. The system according to claim 1, further comprising a locking pin configured to insert through the apertures on the upper bracket and the elongated member.

7. The system according to claim 1, wherein the lifting aperture is configured to allow threading of a rope.

8. The system according to claim 1, wherein the at least one brace is configured to contact at least two vertical beams of the pre-fabricated module.

9. The system according to claim 1, wherein the lifting member is composed of an alloy.

10. The system according to claim 1, wherein the lifting member is composed of a composite.

11. The system according to claim 1, wherein the brace is coated with a protective material.

12. The system according to claim 1, further comprising a pre-fabricated module configured for being lifted by the lifting member and positioned by at least two lifting members, the pre-fabricated module including exterior walls each including a lower aperture and an upper aperture vertically aligned with one another and configured for receiving support pins on the at least one bracket of a lifting member.

13. A system, comprising:

a pre-fabricated module; and a lifting apparatus having a plurality of brackets, wherein a first bracket and a second bracket of the plurality of brackets are positioned on a side of the lifting apparatus, the first bracket comprising a first support pin configured to pass through a first aperture and the second bracket comprising a second support pin configured to pass through a second aperture, and wherein the lifting apparatus further comprises a lifting aperture extending above a top face of an elongated member of the lifting apparatus; and a locking pin configured to pass through at least one aperture of the lifting apparatus and at least one aperture of the first support pin or at least one aperture of the second support pin.

14. The system of claim 13, wherein the locking pin is further configured to pass through the at least one aperture of the first support pin or at least one aperture of the second support pin while a cross-member of the pre-fabricated module is positioned between the locking pin and the first bracket or the second bracket.

15. The system of claim 13, wherein the lifting apparatus further comprises a brace adjacent to the side of the lifting apparatus, wherein the brace is configured to contact the pre-fabricated module.

* * * * *